US008931295B2

(12) United States Patent
Wiggs

(10) Patent No.: US 8,931,295 B2
(45) Date of Patent: Jan. 13, 2015

(54) MULTI-FACETED DESIGNS FOR A DIRECT EXCHANGE GEOTHERMAL HEATING/COOLING SYSTEM

(75) Inventor: B. Ryland Wiggs, Franklin, TN (US)

(73) Assignee: Earth to Air Systems, LLC, Franklin, TN (US)

( * ) Notice: Subject to any disclaimer, the term of this patent is extended or adjusted under 35 U.S.C. 154(b) by 2128 days.

(21) Appl. No.: 12/016,714

(22) Filed: Jan. 18, 2008

(65) Prior Publication Data

US 2008/0173425 A1 Jul. 24, 2008

Related U.S. Application Data

(60) Provisional application No. 60/881,000, filed on Jan. 18, 2007.

(51) Int. Cl.

| | |
|---|---|
| ***F25D 23/12*** | (2006.01) |
| ***F25B 30/06*** | (2006.01) |
| ***F25B 49/00*** | (2006.01) |
| *F25B 13/00* | (2006.01) |

(52) U.S. Cl.

CPC ..... *F25B 30/06* (2013.01); *F25B 49/005* (2013.01); *F25B 13/00* (2013.01); *F25B 2313/002* (2013.01); *F25B 2400/12* (2013.01); *F25B 2500/01* (2013.01); *F25B 2600/0271* (2013.01)

USPC ..... 62/260

(58) Field of Classification Search

USPC ..... 62/160, 260, 324.2, 324.6, 470; 165/45, 165/62

See application file for complete search history.

(56) References Cited

U.S. PATENT DOCUMENTS

| | | | | |
|---|---|---|---|---|
| 2,503,456 | A | | 4/1950 | Smith |
| 2,513,373 | A | * | 7/1950 | Sporn et al. ..... 62/160 |
| 3,099,140 | A | | 7/1963 | Leimbach |
| 3,183,675 | A | | 5/1965 | Schroeder |
| 3,452,813 | A | | 7/1969 | Watkins et al. |
| 3,563,304 | A | * | 2/1971 | McGrath ..... 165/240 |
| 3,986,345 | A | | 10/1976 | Pilz et al. |
| 4,010,731 | A | | 3/1977 | Harrison |
| 4,094,356 | A | | 6/1978 | Ash et al. |
| 4,169,554 | A | | 10/1979 | Camp |
| 4,171,721 | A | * | 10/1979 | Movick ..... 165/45 |
| 4,182,133 | A | | 1/1980 | Haas et al. |
| 4,189,848 | A | | 2/1980 | Ko et al. |
| 4,224,805 | A | | 9/1980 | Rothwell |
| 4,255,936 | A | * | 3/1981 | Cochran ..... 62/238.7 |
| 4,257,239 | A | | 3/1981 | Partin et al. |
| 4,277,946 | A | * | 7/1981 | Bottum ..... 62/235 |

(Continued)

FOREIGN PATENT DOCUMENTS

| | | | |
|---|---|---|---|
| WO | WO-2004/027333 | A2 | 4/2004 |
| WO | WO-2004/013551 | A1 | 12/2004 |

(Continued)

*Primary Examiner* — Melvin Jones

(74) *Attorney, Agent, or Firm* — Miller, Matthias & Hull LLP

(57) ABSTRACT

A direct exchange heating/cooling system with at least one of a reduced compressor size, with a 500 psi high pressure cut-off switch, with a 98% efficient oil separator, with extra oil, operating at a higher pressure than an R-22 system, with receiver design parameters for efficiency and fox capacity, with geothermal heat exchange line set design parameters, with special heating/cooling expansion device sizing and design, with a specially sized air handler, and with a vapor line pre-heater.

18 Claims, 3 Drawing Sheets

(56) References Cited

U.S. PATENT DOCUMENTS

| | | | | |
|---|---|---|---|---|
| 4,286,651 | A | 9/1981 | Steiger et al. | |
| 4,290,266 | A | 9/1981 | Twite et al. | |
| 4,325,228 | A | 4/1982 | Wolf | |
| 4,375,831 | A | 3/1983 | Downing, Jr. | |
| 4,378,787 | A | 4/1983 | Fleischmann | |
| 4,383,419 | A | 5/1983 | Bottum | |
| 4,392,531 | A | 7/1983 | Ippolito | |
| 4,448,237 | A | 5/1984 | Riley | |
| 4,448,238 | A | 5/1984 | Singleton et al. | |
| 4,459,752 | A | 7/1984 | Babcock | |
| 4,536,765 | A | 8/1985 | Kaminski | |
| 4,538,673 | A | 9/1985 | Partin et al. | |
| 4,544,021 | A | 10/1985 | Barrett | |
| 4,700,550 | A | 10/1987 | Rhodes | |
| 4,715,429 | A | 12/1987 | Mogensen | |
| 4,741,388 | A | 5/1988 | Kuroiwa | |
| 4,798,056 | A | 1/1989 | Franklin | |
| 4,858,679 | A | 8/1989 | Sakaya et al. | |
| 4,858,694 | A | 8/1989 | Johnson et al. | |
| 4,867,229 | A | 9/1989 | Mogensen | |
| 4,936,110 | A | 6/1990 | Kuckens | |
| 4,993,483 | A * | 2/1991 | Harris | 165/45 |
| 5,025,634 | A | 6/1991 | Dressler | |
| 5,025,641 | A | 6/1991 | Broadhurst | |
| 5,029,633 | A | 7/1991 | Mann | |
| 5,038,580 | A | 8/1991 | Hart | |
| 5,054,297 | A | 10/1991 | Furuhama | |
| 5,062,276 | A | 11/1991 | Dudley | |
| 5,105,633 | A | 4/1992 | Briggs | |
| 5,131,238 | A | 7/1992 | Meckler | |
| 5,136,855 | A | 8/1992 | Lenarduzzi | |
| 5,199,486 | A | 4/1993 | Balmer et al. | |
| 5,207,075 | A | 5/1993 | Gundlach | |
| 5,224,357 | A | 7/1993 | Galiyano | |
| 5,275,008 | A | 1/1994 | Song et al. | |
| 5,277,032 | A | 1/1994 | See et al. | |
| 5,313,804 | A | 5/1994 | Kaye | |
| 5,381,672 | A | 1/1995 | Haasis | |
| 5,383,337 | A | 1/1995 | Baker | |
| 5,388,419 | A | 2/1995 | Kaye | |
| 5,419,135 | A | 5/1995 | Wiggs | |
| 5,461,876 | A | 10/1995 | Dressler | |
| 5,477,703 | A | 12/1995 | Hanchar et al. | |
| 5,477,914 | A | 12/1995 | Rawlings | |
| 5,533,355 | A | 7/1996 | Rawlings | |
| 5,560,220 | A | 10/1996 | Cochran | |
| 5,561,985 | A | 10/1996 | Cochran | |
| 5,564,282 | A | 10/1996 | Kaye | |
| 5,598,887 | A | 2/1997 | Ikeda et al. | |
| 5,622,057 | A | 4/1997 | Bussjager et al. | |
| 5,623,986 | A | 4/1997 | Wiggs | |
| 5,651,265 | A | 7/1997 | Grenier | |
| 5,671,608 | A | 9/1997 | Wiggs et al. | |
| 5,706,888 | A | 1/1998 | Ambs et al. | |
| 5,725,047 | A | 3/1998 | Lopez | |
| 5,738,164 | A | 4/1998 | Hildebrand | |
| 5,758,514 | A | 6/1998 | Genung | |
| 5,771,700 | A | 6/1998 | Cochran | |
| 5,816,314 | A | 10/1998 | Wiggs et al. | |
| 5,875,644 | A | 3/1999 | Ambs et al. | |
| 5,934,087 | A | 8/1999 | Watanabe et al. | |
| 5,937,665 | A | 8/1999 | Kiessel et al. | |
| 5,937,934 | A | 8/1999 | Hildebrand | |
| 5,941,238 | A | 8/1999 | Tracy | |
| 5,946,928 | A | 9/1999 | Wiggs | |
| 6,138,744 | A | 10/2000 | Coffee | |
| 6,212,896 | B1 | 4/2001 | Genung | |
| 6,227,003 | B1 | 5/2001 | Smolinsky | |
| 6,276,438 | B1 | 8/2001 | Amerman et al. | |
| 6,354,097 | B1 | 3/2002 | Schuster | |
| 6,390,183 | B2 | 5/2002 | Aoyagi et al. | |
| 6,450,247 | B1 | 9/2002 | Raff | |
| 6,521,459 | B1 | 2/2003 | Schooley et al. | |
| 6,615,601 | B1 | 9/2003 | Wiggs | |
| 6,751,974 | B1 | 6/2004 | Wiggs | |
| 6,789,608 | B1 | 9/2004 | Wiggs | |
| 6,892,522 | B2 | 5/2005 | Brasz et al. | |
| 6,931,879 | B1 | 8/2005 | Wiggs | |
| 6,932,149 | B2 | 8/2005 | Wiggs | |
| 6,971,248 | B1 | 12/2005 | Wiggs | |
| 7,080,524 | B2 | 7/2006 | Wiggs | |
| 7,146,823 | B1 | 12/2006 | Wiggs | |
| 7,191,604 | B1 | 3/2007 | Wiggs | |
| 7,234,314 | B1 | 6/2007 | Wiggs | |
| 7,401,641 | B1 | 7/2008 | Wiggs | |
| 2002/0132947 | A1 | 9/2002 | Smith et al. | |
| 2002/0194862 | A1 | 12/2002 | Komatsubara | |
| 2003/0037555 | A1 | 2/2003 | Street et al. | |

FOREIGN PATENT DOCUMENTS

| | | | |
|---|---|---|---|
| WO | WO-2005/114073 | A2 | 12/2005 |
| WO | WO-2007/046788 | A2 | 4/2007 |

* cited by examiner

MULTI-FACETED DESIGNS FOR A DIRECT EXCHANGE GEOTHERMAL HEATING/COOLING SYSTEM

CROSS-REFERENCE TO RELATED APPLICATIONS

This application claims the benefit of U.S. Provisional Application No. 60/881,000, filed Jan. 18, 2007.

FIELD OF THE DISCLOSURE

The present disclosure relates to a geothermal direct exchange ("DX") heating/cooling system, which is also commonly referred to as a "direct expansion" heating/cooling system, comprising various design improvements.

BACKGROUND OF THE DISCLOSURE

Conventional geothermal ground source/water source heat exchange systems typically use liquid-filled closed loops of tubing (typically approximately ¼ inch wall polyethylene tubing) buried in the ground, or submerged in a body of water, so as to either absorb heat from, or to reject heat into, the naturally occurring geothermal mass and/or water surrounding the buried or submerged liquid transport tubing. The tubing loop, which is typically filled with water and optional antifreeze and rust inhibitors, extends to the surface. A water pump circulates the naturally warmed or cooled liquid to a liquid-to-refrigerant heat exchanger.

Transfer of geothermal heat to or from the ground to the liquid in the plastic piping is a first heat exchange step. Via a second heat exchange step, a refrigerant heat pump system transfers heat to or from the liquid in the plastic pipe to a refrigerant. Finally, conventional systems may use a third heat exchange step, in which an interior air handler (comprised of finned tubing and a fan) transfers heat to or from the refrigerant to heat or cool interior air space.

Newer design geothermal DX heat exchange systems, where the refrigerant fluid transport lines are placed directly in the sub-surface ground and/or water, typically circulate a refrigerant fluid, such as R-22, R-410A, or the like, in sub-surface refrigerant lines, typically comprised of copper tubing, to transfer geothermal heat to or from the sub-surface elements via a first heat exchange step DX systems only require a second heat exchange step to transfer heat to or from the interior air space, typically by means of an interior air handler. Consequently, DX systems are generally more efficient than water-source systems because fewer heat exchange steps are requited and because no water pump energy expenditure is necessary. Further, since copper is a better heat conductor than most plastics, and since the refrigerant fluid circulating within the copper tubing of a DX system generally has a greater temperature differential with the surrounding ground than the water circulating within the plastic tubing of a water-source system, generally less excavation and drilling is required (and installation costs are typically lower) with a DX system than with a water-source system While most in-ground/in-water DX heat exchange designs are feasible, various improvements have been developed intended to enhance overall system operational efficiencies. Several such design improvements, particularly in direct expansion/direct exchange geothermal heat pump systems, are taught in U.S. Pat. No. 5,623,986 to Wiggs; in U.S. Pat. No. 5,816,314 to Wiggs, et al; in U.S. Pat. No. 5,946,928 to Wiggs; and in U.S. Pat. No. 6,615,601 B1 to Wiggs, the disclosures of which are incorporated herein by reference.

Such disclosures encompass both horizontally and vertically oriented sub-surface heat geothermal heat exchange means, using historically conventional refrigerants, such as R-22, as well as a newer design of refrigerant identified as R-410A. R-410A is an HFC azeotropic mixture of HFC-32 and HFC-125.

DX heating/cooling systems have three primary objectives. The first is to provide the greatest possible operational efficiencies, which enables the lowest possible heating/cooling operational costs as well as other advantages such as, for example, materially assisting in reducing peaking concerns for utility companies. A second objective is to operate in an environmentally safe manner by using environmentally safe components and fluids. The third objective is to operate for long periods of time absent the need for any significant maintenance/repair; thereby materially reducing servicing and replacement costs over other conventional system designs.

Historically, while DX heating/cooling systems are generally more efficient than other conventional heating/cooling systems, they present installation limitations due to the relatively large surface land areas necessary to accommodate the sub-surface heat exchange tubing. In horizontal "pit" systems, for example, a typical land area of 500 square feet per ton of system design capacity was required in first generation designs to accommodate a shallow (within 10 feet of the surface) matrix of multiple, distributed, copper heat exchange tubes. Further, in various vertically oriented first generation DX system designs, about one to two 50-100 foot (maximum) depth wells/boreholes pet ton of system design capacity are needed, with each well spaced at least about 20 feet apart, and with each well containing an individual refrigerant transport tubing loop. Such requisite surface areas effectively precluded system applications in many commercial and/or high density residential applications. An improvement over such predecessor designs was taught by Wiggs, which enabled a DX system to operate within wells/boreholes that were about 300 feet deep, thereby materially reducing the necessary land surface area requirements for a DX system. Historically, copper tubing has been used for sub-surface refrigerant transport purposes in DX system applications.

SUMMARY OF THE DISCLOSURE

Multi-faceted means are used to improve upon earlier and former DX system technologies, so as to provide environmentally safe designs with maximum operational efficiencies under varying conditions and minimal maintenance requirements, all at the lowest possible initial cost. These improvement means are described as follows:

Compressor Design: In conventional DX and other heat pump systems, the compressor is sized to match the system load design, so that a 3 ton system typically calls for a 3 ton compressor. One ton of capacity design in the heating/cooling field equals 12,000 BTUs. Thus a 3 ton heating and/or cooling load design for a structure would typically require a system with a 3 ton capacity design compressor. Load designs are typically calculated via ACCA Manual J, or similar criteria. Due to the unique DX system design improvements taught herein, however, the actual sizing requirement of the compressor can be reduced, thereby requiring less operational power draw and increasing system operational efficiencies. Using some or all of the improvements disclosed herein, testing has indicated that the compressor size is preferably between 80% and 95% of the aforesaid conventional sizing criteria for the maximum calculating heating/cooling load. For example, for a 3 ton system load design, the compressor should not have a 36,000 BTU operational capacity, but, instead, should have an operational capacity of between 28,800 and 34,200 BTUs. This acceptable range is necessary because not all compressor manufacturing companies produce compressors at the same BTU capacities.

Oil Separator: Oil separators have been known and used in various conventional heat pump system Oil separators typically consist of a metal cylinder or other container having a wire mesh or netting that filters oil from the refrigerant. The filtered oil drops to the bottom of the cylinder via gravity, mostly permitting only the refrigerant to escape into the test of the system from the top of the cylinder. When a sufficient quantity of oil accumulates in the bottom of the cylinder, a steel float, or the like, rises to expose a hole through which the oil is pulled, via compressor suction, back directly into the compressor itself via an oil return line from the bottom of the oil separator to the compressor, Conventional separators, however, typically only filter to 100 microns and are only 80% to 90% efficient, which is unacceptable for a DX system with vertically oriented geothermal heat exchange tubing.

Testing has shown that, in a DX system, it most of the lubricating oil within the compressor is not kept out of the geothermal heat exchange field lines, especially if the field lines are vertically inclined, the oil from the compressor will tend to remain in the field lines when the DX system is operating in the heating mode, and the compressor will be damaged from lack of adequate return lubrication. Thus, an improved oil separator design for a DX system is preferable.

Such an improved design is comprised of an oil separator with an ability to filter to at least 0.3 microns with at least 98% efficiency. A preferred filter is formed of a glass material, such as a borosilicate filter, or the like Further, a certain amount of extra oil should preferably be added so as to compensate for any minimal losses to the field during the heating mode of operation, when a mostly vapor form refrigerant is returned to the compressor from the geothermal heat exchange tubing in the field. The amount of extra oil should be equal to an amount needed to fill the bottom of the oil separator containment vessel to a specified point below the filter within the separator during system operation. Preferably, so as to permit some margin of error in total oil content, the amount of extra oil added would be such as to leave a ½ inch, plus or minus ¼ inch, vertical margin between the bottom of the oil filter and the top of the extra oil level within the containment vessel (one-half inch below the base/bottom of the filter within the oil separator). If too much extra oil were supplied, the requisite design filter area would become impaired and/or blocked from its intended use. Extra oil is herein defined as an amount of compressor lubricating oil over and above the amount of oil customarily provided by a compressor manufacturer within a compressor Additionally, conventional oil separators provide no means to ascertain whether the oil separator is properly functioning during operation, or whether additional oil ever needs to be added. Currently such issues are detected only after the compressor malfunctions or burns up. Thus, an improvement providing a means to check the actual functioning of the oil separator, as well as the actual oil level within the oil separator, would be preferable. The present disclosure includes a sight glass within the wall of the oil separator to allow the oil level to be visually ascertained. The sight glass is positioned so that the desired oil level is at ox near the center of the sight glass when the DX system is inoperative. The desired oil level is a predetermined distance, such as approximately ½ inch, below the bottom of the filter. When the DX system is operating, proper functioning of the separator can be observed through the sight glass by means of looking for layered sheets of oil falling down the interior sight glass wall.

Lastly, various known oil separators historically return oil directly to the compressor. A preferred means of oil return would be in a metered manner. A metered oil return is accomplished by returning the oil through a suction line to the system's accumulator, or to the accumulator itself. Accumulators are well understood by those skilled in the art, and consist of a refrigerant containment vessel with a vapor line U bend inside. The top of the U bend pulls vapor refrigerant from the top of the accumulator and sends it into the compressor, while any refrigerant in liquid form, which could "slug" the compressor, remains at the bottom of the vessel. However, the U bend tube within the accumulator has a small hole or orifice at the bottom which continuously pulls and returns a small mixture of oil and liquid refrigerant from the bottom, thereby to fully circulate the oil back to the compressor. As is generally known in the art, the small orifice is sized according to the system size. In a 2-5 ton system, for example, the orifice is typically about 0.4 to 0.55 inches in diameter. Thus, in the subject improved design, the conventional small oil return hole returns the oil from the separator to the compressor in a metered fashion, instead of directly to the actual compressor itself in an un-metered flow, conventionally through a relatively large ⅝ inch O.D. discharge line, or the like. Such a large oil return line also increases the likelihood of returning hot discharge refrigerant vapor to the compressor along with the oil, which decreases system efficiencies.

As a further design improvement of the oil separator oil return means for a DX system, an additional amount of oil should preferably be added to the accumulator itself (which is not historically done), so as to help insure that the bottom of the accumulator is always filled with oil to a level above the small oil (orifice) return hole, and preferably to a point that is between 1/16 inch and ¼ inch above the top of the hole. This will help insure a maximum amount of extra oil is operably placed within the system, but not so much as to impair the intended operation of either the accumulator or the filter within the oil separator, and will not materially impair the receiver's ability to contain adequate amounts of liquid refrigerant so as not to slug the compressor Higher Operational Pressure Refrigerant: Conventional DX systems operate on R-22 or like refrigerants However, testing has shown that superior operational efficiencies are attained in a DX system, especially in a DX system with vertically oriented geothermal heat exchange refrigerant transport tubing designs, when a refrigerant with operating pressures at least 25% greater than those of R-22, or the like, refrigerants are used. This is because at significant depths, the greater operational refrigerant pressure materially helps to offset the adverse effect of gravity on the liquid refrigerant within the liquid return line during cooling mode operation, thereby reducing compressor power draw requirements and increasing system operational efficiencies R-410A is one example of a refrigerant having at least a 25% greater operational pressure than that of R-22. The operational pressures of R-22 are well known in the art Stronger System Components: As a direct relation to the use of a preferred refrigerant with at least a 25% greater operational pressure than that of R-22, all components of a DX system using such a higher pressure refrigerant must have comparable safe working loads at least 25% greater than conventionally designed for R-22, or the like, refrigerant systems. The operating pressures of R-22, and R-22 system component safe working load strengths are well understood by those skilled in the art.

High Pressure Cut-Off Switch: High pressure cut-off switches are well understood by those skilled in the art. In an improved DX system design operating with minimal power expenditures, however, testing has shown that system operational refrigerant pressures are lower than normal. Consequently, for a DX system using R-410A, or similar; refrigerant, the high pressure cut off switch should preferably be designed to shut of the compressor when operational system pressures teach a level of at least 500 psi, plus or minus no more than 25 psi. This permits the utilization of sufficiently strong system components, but the use of components that need not be as strong as those used in conventional air-source R-410A heat pump system designs, where higher operational pressures are typically encountered in the cooling mode, due to the potential and usual higher condensing temperature ranges encountered in the outdoor air in the summer Conventional air-source R-410A heat pumps typically require high pressure cut-off switches in the 600-650 psi range. Since DX system components, operating with an R-410A refrigerant, can be sufficiently strong, but not needlessly excessively strong, DX system equipment manufacturing costs can be reduced so as to operate with a 500 psi safe working load, as opposed to a 600 psi safe working load.

Receiver Sizing: The use of receiver's in conventional heat pump systems, as well as in DX systems, is known. However, conventional DX system receiver designs are far from optimum. This is because early devices involving the use of receivers in DX systems incorporated the inefficient use of oil return lines from the receiver to the compressor, or established an inappropriate basis for determining the preferred receiver sizing and/or refrigerant containment amount.

Testing has shown that in a DX system design, especially in a DX system design incorporating the use of vertically oriented geothermal heat exchange tubing, such as in a well/borehole design application, where the length of the exposed vapor heat exchange line is closely analogous to the length of the fully, or partially, insulated liquid refrigerant transport line, the receiver should preferably be designed to contain 16%, plus or minus 2% of the full potential liquid content of the exposed heat transfer portion of the vapor refrigerant transport line(s) in the geothermal heat exchange field for maximum latent load removal capacity and good efficiencies. Alternatively, if maximum operational efficiencies are desired in the cooling mode, with good latent load removal capacity, the receiver should preferably be designed to contain 8%, plus or minus 2%, of the full potential liquid content of the exposed heat transfer portion of the vapor refrigerant transport line(s) in the geothermal heat exchange field. The full potential liquid content of the exposed heat transfer portion of the vapor refrigerant transport line(s) in a geothermal heat exchange field is equal to the weight of the refrigerant fluid-filled interior volume area of the line(s).

Unlike conventional receiver designs that generally depend on system refrigerant pressures to automatically adjust the receiver's liquid refrigerant content, the preferable receiver as disclosed herein, is situated in the liquid refrigerant transport line between the air handler and the heating mode expansion device, has a liquid transport line exiting the upper portion of the receiver in the heating mode, and has a liquid line exiting the lower portion of the receiver in the cooling mode, with the interior space between the entering and exiting liquid transport lines within the receiver configured to retain the above specified amount of liquid in the heating mode, but to release the full above specified amount of liquid into the system's well(s)/borehole(s) in the cooling mode.

Liquid and Vapor Line Sizing: In various DX system designs, liquid and vapor line sizing varies. However, testing has shown that optimum efficiency results on an annual basis come from the use of a vertically oriented well/borehole system design that takes advantage of the year round stable subsurface temperatures at depths in excess of 65.5 feet deep. In a vertically-oriented, horizontally-oriented, or other loop configuration, the preferable line set sizing for a 30,000 BTU capacity, or less, compressor is one or two ⅜" O.D. refrigerant grade liquid refrigerant transport line(s), in conjunction with a corresponding number of either one or two vapor refrigerant grade transport line(s), with each vapor line having an O.D. that is between 2 to 2.4 times as large as the O.D. of the liquid line. The preferable line set sizing for a compressor above a 30,000 BTU capacity, but less than a 90,000 BTU capacity, is two or three ⅜" O.D. refrigerant grade liquid refrigerant transport line(s), in conjunction with a corresponding number of two to three vapor refrigerant grade transport line(s) with each vapor line having an O.D. that is between 2 to 2.4 times as large as the O.D. of the liquid line.

A preferable design in sub-surface environments with at least a 1.4 BTU/Ft·Hr. Degrees F. heat transfer rate would be at least 120 feet of exposed vapor line per ton of the greater of the heating and cooling design load capacities. When subsurface conditions permit, the minimum number of line sets should be used. However, for example, if a large cave or void was encountered at a depth that would preclude the minimum number of well/boreholes, one additional well could be drilled per system so as to effectively shorten the requisite depth of the other well(s)/borehole(s), all while using the above disclosed liquid and vapor line sizes in each respective well/borehole.

When two or more wells/boreholes are required for system compressor design loads of over 30,000 BTUs and up to 90,000 BTUs, the primary liquid refrigerant transport line should preferably be comprised of a ½" O.D. refrigerant grade line, and the primary vapor refrigerant transport line should preferably be a ⅞" O.D. refrigerant grade line. Each of the larger lines is distributed to a respective, smaller O.D. liquid and vapor lines servicing each respective well/borehole.

Interior Air Handler: Interior air handlers are well known by those skilled in the art, and primarily consist of finned tubing and a fan (a blower) within a sealed box, through which return interior air is blown to be heated or cooled by the warm or cool refrigerant circulating within the finned refrigerant transport tubing, depending on whether the system is operating in the heating or cooling mode. However, while residential air handlers typically have multiple rows of finned (typically 12 to 14 fins per inch) ⅜" O.D. refrigerant transport tubing that is used for refrigerant to interior air heat exchange, virtually no air handlers are uniform in the design of how many feet of finned ⅜" O.D. tubing is used per ton of system design heating/cooling capacity. For purposes of this disclosure, a certain preferable number of linear feet pet ton of system load design (where 1 ton equals 12,000 BTUs, and where load designs are typically as per ACCA Manual J, or the like, as is well understood by those skilled in the art) is used. Testing has shown the preferable number of linear feet of ⅜" O.D. finned (12 to 14 fins per lineal inch) tubing per ton of system load design for a DX system is approximately 72 linear feet, plus or minus 12 feet. For this preferred length of finned tubing, the airflow is preferably approximately 400 CFM per ton of system design capacity for both heating and cooling modes of operation, up to 450 CFM per ton of system design capacity in the cooling mode, and down to 350 CFM per ton of system design capacity in the heating mode.

Heating Mode Expansion Device: Conventional heating mode expansion devices are well understood by those skilled in the art, and typically consist of one of a fixed orifice pin restrictor (commonly referred to as a "pin restrictor") and a self-adjusting expansion device (commonly referred to as a "TXV"). The heating mode expansion device is typically positioned immediately prior to the refrigerant's entry into the exterior heat absorption area, so as to expand the refrigerant vapor and reduce its temperature/pressure, so as to better enable it to absorb heat from the exterior air or geothermal heat source.

Testing has shown that in a DX system, the heating mode expansion device should not be a commonly used standard self-adjusting expansion device in the heating mode, as the relatively extensive distance the refrigerant must travel in a sub-surface DX system, as opposed to that of an air-source or water-source heat pump system, is so great that a self adjusting valve is too frequently "hunting" for an optimum setting, thereby creating widely fluctuating and frequently inefficient valve settings. Thus, testing has shown that a fixed orifice pin restrictor expansion device may be used in the heating mode. A fixed orifice pin restrictor expansion device is well understood by those skilled in the art, and consists of a rounded nose bullet shaped pin, with a specially sized orifice through its center. The pin typically has fins on its sides and is encased within a special housing that restricts the refrigerant flow through the center orifice in the heating mode, but that permits full refrigerant flow in the cooling mode, when the refrigerant is traveling in a reverse direction, via flow both through the center orifice and around the pin's fins, as the pin is pushed back into a containment provision that does not restrict the refrigerant flow through the center orifice as is done in the heating mode.

Testing has shown that not only is a fixed orifice pin restrictor expansion device preferable, but that the size of the center orifice should preferably be sized set forth herein, plus or minus no more than 10% The heating mode liquid refrigerant transport line to the geothermal heat exchange field is typically comprised of one line that is distributed into two or more lines. Preferred pin restrictor orifice sizes are shown herein in inches: for a single liquid line servicing a 30,000 BTU, or smaller; compressor used in a DX system; for a single line that has been distributed into two liquid lines servicing over a 30,000 BTU compressor; and for a single line that has been distributed into three liquid lines servicing an 87,000 BTU compressor. In a preferred DX system design, at least two distributed liquid lines would travel to the geothermal heat exchange field, preferably in a vertically oriented deep well/borehole geothermal heat exchange system design. However, whether one or more liquid lines are used, with respective pin restrictors in each respective liquid line to the field, the total combined hole/bore size is what must be equally divided among the number of fixed orifice pin restrictors preferred to be used in any particular system, based upon the following criteria of hole/bore size per compressor size and resulting ratios:

Heating Mode Pin Restrictor Size, in Inches, Per System Compressor Size in BTUs, when the Heating Mode Load Design is Two-Thirds, or Less, of the Cooling Mode Load Design Compressor BTUs—Heating Mode—Pin Restrictor Bore Size in Inches For a Single Line DX System (One Pin of the Size Outlined Below in the Sole Liquid Line to the Field)—Heating Mode

| | |
|---|---|
| 13,400 | 0.034 |
| 16,000 | 0.039 |
| 18,000 | 0.041 |
| 19,000 | 0.042 |

-continued

| | |
|---|---|
| 20,000 | 0.044 |
| 20,100 | 0.044 |
| 21,000 | 0.045 |
| 22,000 | 0.046 |
| 23,000 | 0.048 |
| 24,000 | 0.049 |
| 25,000 | 0.050 |
| 26,000 | 0.051 |
| 26,800 | 0.052 |
| 27,000 | 0.052 |
| 28,000 | 0.053 |
| 29,000 | 0.054 |
| 30,000 | 0.055 |

For a Double Line DX System (Two Pins . . . One Pin of the Size Outlined Below in Each of two Liquid Lines to the Field When the Primary Liquid Line is Equally Distributed into Two Liquid Refrigerant Transport Lines)—Heating Mode

| | |
|---|---|
| 31,000 | 0.040 |
| 32,000 | 0.040 |
| 33,000 | 0.040 |
| 34,000 | 0.041 |
| 34,170 | 0.041 |
| 35,000 | 0.041 |
| 36,000 | 0.042 |
| 37,000 | 0.043 |
| 38,000 | 0.043 |
| 39,000 | 0.043 |
| 40,000 | 0.044 |
| 41,000 | 0.044 |
| 42,000 | 0.044 |
| 43,000 | 0.044 |
| 44,000 | 0.045 |
| 45,000 | 0.045 |
| 46,000 | 0.045 |
| 47,000 | 0.046 |
| 48,000 | 0.046 |
| 49,000 | 0.046 |
| 50,000 | 0.047 |
| 51,000 | 0.047 |
| 52,000 | 0.047 |
| 53,000 | 0.047 |
| 54,000 | 0.048 |
| 55,000 | 0.049 |
| 56,000 | 0.049 |
| 57,000 | 0.050 |
| 58,000 | 0.050 |
| 59,000 | 0.050 |
| 60,000 | 0.050 |

For a Triple Line DX System (Three Pins . . . One Pin of the Size Outlined Below in Each of Three Liquid Lines to the Field When the Primary Liquid Line is Equally Distributed into Three Liquid Refrigerant Transport Lines)—Heating Mode

| | |
|---|---|
| 87,000 | 0.048 |

Heating Mode Pin Restrictor Size, in Inches, Per System Compressor Size in BTUs, when the Cooling Mode Load Design is Over Two-Thirds of the Heating Mode Load Design Compressor BTUs–Heating Mode—Pin Restrictor Bole Size in Inches For a Single Line DX System (One Pin of the Size Outlined Below in the Sole Liquid Line to the Field)—Heating Mode

| Compressor Size | Pin Size |
|---|---|
| 13,400 | 0.031 |
| 16,000 | 0.036 |
| 18,000 | 0.038 |
| 19,000 | 0.039 |
| 20,000 | 0.040 |
| 20,100 | 0.040 |
| 21,000 | 0.042 |
| 22,000 | 0.043 |
| 23,000 | 0.044 |
| 24,000 | 0.045 |
| 25,000 | 0.046 |
| 26,000 | 0.047 |
| 26,800 | 0.048 |
| 27,000 | 0.048 |
| 28,000 | 0.049 |
| 29,000 | 0.050 |
| 30,000 | 0.051 |

For a Double Line DX System (Two Pins . . . One Pin of the Size Outlined Below in Each of two Liquid Lines to the Field When the Primary Liquid Line is Equally Distributed Into Two Liquid Refrigerant Transport Lines)—Heating Mode

| Compressor Size | Pin Size |
|---|---|
| 31,000 | 0.036 |
| 32,000 | 0.037 |
| 33,000 | 0.037 |
| 34,000 | 0.038 |
| 34,170 | 0.038 |
| 35,000 | 0.038 |
| 36,000 | 0.038 |
| 37,000 | 0.039 |
| 38,000 | 0.040 |
| 39,000 | 0.040 |
| 40,000 | 0.040 |
| 41,000 | 0.041 |
| 42,000 | 0.041 |
| 43,000 | 0.041 |
| 44,000 | 0.042 |
| 45,000 | 0.042 |
| 46,000 | 0.042 |
| 47,000 | 0.042 |
| 48,000 | 0.042 |
| 49,000 | 0.043 |
| 50,000 | 0.043 |
| 51,000 | 0.043 |
| 52,000 | 0.044 |
| 53,000 | 0.044 |
| 54,000 | 0.044 |
| 55,000 | 0.045 |
| 56,000 | 0.045 |
| 57,000 | 0.045 |
| 58,000 | 0.046 |
| 59,000 | 0.046 |
| 60,000 | 0.046 |

For a Triple Line DX System (Three Pins . . . One Pin of the Size Outlined Below in Each of Three Liquid Lines to the field When the Primary Liquid Line is Equally Distributed Into Three Liquid Refrigerant Transport Lines)—Heating Mode

| Compressor Size | Pin Size |
|---|---|
| 83,000 | 0.044 |

The above compressor size to pin size provide obvious ratios, which ratios can be used to provide the correct hole/bore size for a heating mode pin restrictor expansion device for any compressor size when the DX system is operating in the heating mode.

Cooling Mode Expansion Device: Conventional cooling mode expansion devices are well understood by those skilled in the art, and typically consist of one of a fixed orifice pin restrictor (commonly referred to as a "pin restrictor") and a self-adjusting expansion device (commonly referred to as a "IXV"). The cooling mode expansion device is typically positioned in the mostly liquid refrigerant transport line immediately prior to the refrigerant's entry into the interior air handler, so as to expand the refrigerant vapor and reduce its temperature/pressure, so as to better enable it to absorb waste heat from the interior air. Generally, a self-adjusting (IXV) cooling mode expansion device is preferred because it automatically accommodates varying conditions.

However, in a DX system, at the end of a heating season the ground is colder than normal, periodically even below freezing, having supplied heat to the circulating refrigerant for use in interior air space heating during the winter. This situation is not observed in a conventional air source system, as when the air-source heat pump is turned on, the outdoor air is typically near, or above, the 70 degree F. range. Conventional cooling mode TXVs, which are well under stood by those skilled in the art, are not designed to efficiently operate when the temperature of the liquid refrigerant traveling to the TXV is below about 47 degrees F., which can occur in a DX system design at the end of a heating season and beginning of a cooling season. When such a situation occurs in a DX system design, such that the refrigerant exiting the geothermal heat exchange field and entering the IXV (prior to entering the interior air handler) is below about 47 degrees F., the IXV does not function well, and system compressor suction psi levels remain too low, typically below 50 psi.

To correct this problem, unique to a DX system application, several methods are taught herein. One is to increase the refrigerant charge, typically by a factor of 100%. However, this requires one to remove the additional refrigerant when normal system subsurface operating temperatures are achieved via heat sufficient being rejected into the ground to return the ground to normal, and above normal, temperatures and, is, therefore not a preferred collection means/method.

Another and preferred method is to by-pass the TXV with enough additional refrigerant flow so as to increase the operational compressor suction psi above 50, but with not enough additional refrigerant flow to impair the operation of the nearby TXV under peak cooling load conditions. Extensive testing has demonstrated that this is one preferred means of satisfactorily resolving the concern, and is accomplished by providing a TXV by-pass means comprised of adding a liquid refrigerant transport line (typically of a ⅜ inch O.D. size) to go around the TXV itself, with at least one of a fixed orifice pin restrictor of a certain preferred size positioned within the added TXV by-pass line and a pressure self-regulating valve installed within the added IXV by-pass line. Alternately, a small hole/passageway could be provided within the TXV itself (typically called a bleed port) of a preferred size so as to accomplish the same preferred means A bleed port in a TXV is well under stood by those skilled in the art and will not be described hereinafter via a drawing. However, the preferred size of such a bleed port has not previously been known for such a DX system application, when the ground is abnormally cold during a cooling mode system operation.

When a fixed orifice pin restrictor is used in a TXV by-pass line, or via providing the TXV itself with a bleed port, the sizing of the hole/bore (orifice) within the pin, or the TXV bleed port, must be of a preferred size, otherwise insufficient additional refrigerant is permitted to supplement the TXV when suction pressures are below 50 psi, or too much refrigerant is permitted to supplement the TXV so as to impair conventional TXV operation when normal sub-surface temperatures have been restored, or exceeded, via waste heat being rejected into the ground over some continuous cooling mode operational period.

Extensive testing has demonstrated the preferred size of the hole/bore (orifice) within a pin restrictor expansion device, by-passing the TXV expansion device in the air handler, or a TXV bleed port in the TXV servicing the air handler, is as per the following design equivalencies, plus or minus 10%, in the cooling mode:

| Actual Compressor Size n BTUs | Pin Size, also known as the interior hole/bore (orifice) size, in inches, for a TXV refrigerant flow supplement (by-pass) means |
|---|---|
| 16,000 BTUs | 0.044 |
| 21,000 BTUs | 0.050 |
| 25,000 BTUs | 0.055 |
| 29,000 BTUs | 0.059 |
| 32,000 BTUs | 0.062 |
| 38,000 BTUs | 0.065 |
| 44,000 BTUs | 0.070 |
| 51,000 BTUs | 0.076 |
| 54,000 BTUs | 0.078 |
| 57,000 BTUs | 0.081 |

The above compressor size to pin size provide ratios that can be used to provide the correct hole/bore (orifice) size for a TXV refrigerant flow supplement/by-pass means for any compressor size when the DX system is operating in the cooling mode.

In lieu of a pin restrictor within a TXV by-pass line, and in lieu of a TXV with a bleed port, a pressure regulated valve may used in the IXV by-pass line, where the pressure regulated valve is sized to permit full refrigerant flow through the valve until the compressor's suction pressure reaches 80 psi, plus or minus 20 psi, at which point the valve automatically closes, with the system thereby fully functioning without any refrigerant TXV by-pass flow.

Pressure regulated valves are well understood by those skilled in the art, but have not been previously used in a DX system design for such a unique purpose. Use of a pressure regulated valve in the TXV by-pass line is preferred if expedited cooling mode operation and faster suction pressure increases are preferred, while use of a fixed orifice pin restrictor is preferred if the lowest possible component cost is preferred.

Vapor Line Pre-Heater: In any heat pump system, the mostly liquid refrigerant transport line exiting the system's interior air handler in the heating mode is filled with warm refrigerant, typically in the upper 70 to lower 90 degree F. temperature range. Prior to entering the exterior heat exchange means (the evaporator in the heating mode), this warm, mostly liquid, refrigerant fluid is sent through a heating mode expansion device to reduce the temperature/pressure so as to enable the now cold refrigerant to naturally absorb the usually warmer heat from the exterior environment. However, in an air-source system, if the refrigerant fluid sent to exchange heat with the exterior air is below freezing, moisture in the air will be attracted to the typically finned exterior refrigerant transport tubing and will freeze, eventually resulting in ice build-up, which ice blocks the design air flow (via an exterior fan) over the finned tubing. When ice blocks the design airflow, an expensive "de-frost" cycle operation is required, which essentially changes the heat pump's mode of operation into the cooling mode, so as to send hot refrigerant vapor into the exterior tubing to melt the ice, all while the heat being removed from the interior air, via cooling mode operation in the winter, must be replaced with supplemental heat, such as expensive electric resistance heat or dangerous fossil fuel heat. Thus, in an air-source system, it is not necessarily advantageous to reduce the heat level of the warm, mostly liquid, refrigerant leaving the air handler before it enters the heating mode expansion device, as lowering the temperature into the expansion could potentially result in lowering the temperature of the refrigerant fluid exiting the heating mode expansion device, and thereby increase de-frost cycle operation concerns.

However, in a DX system, there is no defrost cycle concern as there is no finned tubing exposed to the moisture in the exterior air. Thus, in a DX system, testing has shown it is advantageous to use the heat in the warm refrigerant liquid line, before the refrigerant enters the heating mode expansion device (preferably a fixed orifice pin restrictor expansion device as hereinabove explained) so as to naturally provide extra heat to the vapor line exiting the sub-surface geothermal heat exchange field (which field exiting vapor line is typically only in the 35 degree F. to 60 degree F. temperature range) before it teaches the system's compressor, all absent any additional operational energy requirements/power draw. Such a compressor vapor suction line pre-heater means provides warmer and more comfortable interior supply air via the interior air handler, and at least one of (a) has no effect on the temperature of the refrigerant exiting the heating mode expansion device because the refrigerant temperature/pressure on the air handler/pre-heater side of the expansion device is still higher than that of the refrigerant on the field side, and (b) reduces the temperature of the refrigerant entering the expansion device, as well as exiting the expansion device, so as to enhance the temperature differential between the cold refrigerant and the ground, thereby providing better geothermal heat transfer, and increasing overall system heating mode operational efficiencies.

The above-described suction vapor line pre-heater for a DX system would be operative in the heating mode and would be comprised of with a heat exchanger positioned between the warm, mostly liquid, refrigerant transport line exiting the system's interior air handler, at a location before the refrigerant flow teaches the heating mode expansion device, and the refrigerant vapor transport line exiting the geothermal heat exchange means, before the refrigerant flow exiting the geothermal heat exchange means entered the system's compressor, which vapor line pre-heater would be by-passed and not used in the cooling mode.

Such a heat exchanger would consist of, for example, the warm liquid line (preferably finned at this particular pre-heater location) being disposed within an insulated containment vessel, such as a tube, or the like, transferring the warmer heat within the liquid refrigerant exiting the air handler (before the heating mode expansion device) to the cooler vapor exiting from the ground on its way to the system's compressor, so as to effect natural heat exchange via heat naturally flowing to cold. The containment vessel would preferably be liquid filled so as to enhance heat transfer between the respective liquid line and vapor line segments within the containment vessel. The respective liquid and vapor transport lines could also be directly wrapped around one another and insulated as another means of providing the subject heat transfer, for example.

While it is known to use the heat in the refrigerant exiting the interior air handler in a low temperature air-source heat pump system, the use of such heat is made via a secondary system compressor, which requires an additional system power draw. An additional secondary compressor provides warmer interior air but also decreases overall system operational efficiency levels, which is counterproductive in a DX system application where the highest possible operational efficiencies are usually a primary concern.

In the cooling mode, the subject heat exchange means would not be used, as it would be counterproductive, and instead would be by-passed via refrigerant tubing and check valves, or the like. The vapor line servicing the pre-heater assembly should, therefore, preferably be provided with a first check valve, which is open in the heating mode, and a second check valve, which is closed in the heating mode, so as to force the liquid refrigerant through the pre-heater/box in the heating mode. In the cooling mode, the first check valve may be closed, and the second check valve may be open, to keep the liquid refrigerant out of the box and to avoid providing unwanted additional heat to the cool liquid line traveling to the air handler (in the cooling mode) from the hot gas/vapor line exiting the system's compressor.

BRIEF DESCRIPTION OF THE DRAWINGS

The drawings illustrate embodiments of the disclosure as presently preferred. It should be understood, however, that this disclosure is not limited to the precise arrangements and instrumentalities shown.

DETAILED DESCRIPTION

The following detailed description is of the best presently contemplated mode of carrying out the claimed subject matter. The description is not intended in a limiting sense, and is made solely for the purpose of illustrating the general principles of the disclosure. The various features and advantages of this disclosure may be more readily understood with reference to the following detailed description taken in conjunction with the accompanying drawings.

Figure 1:
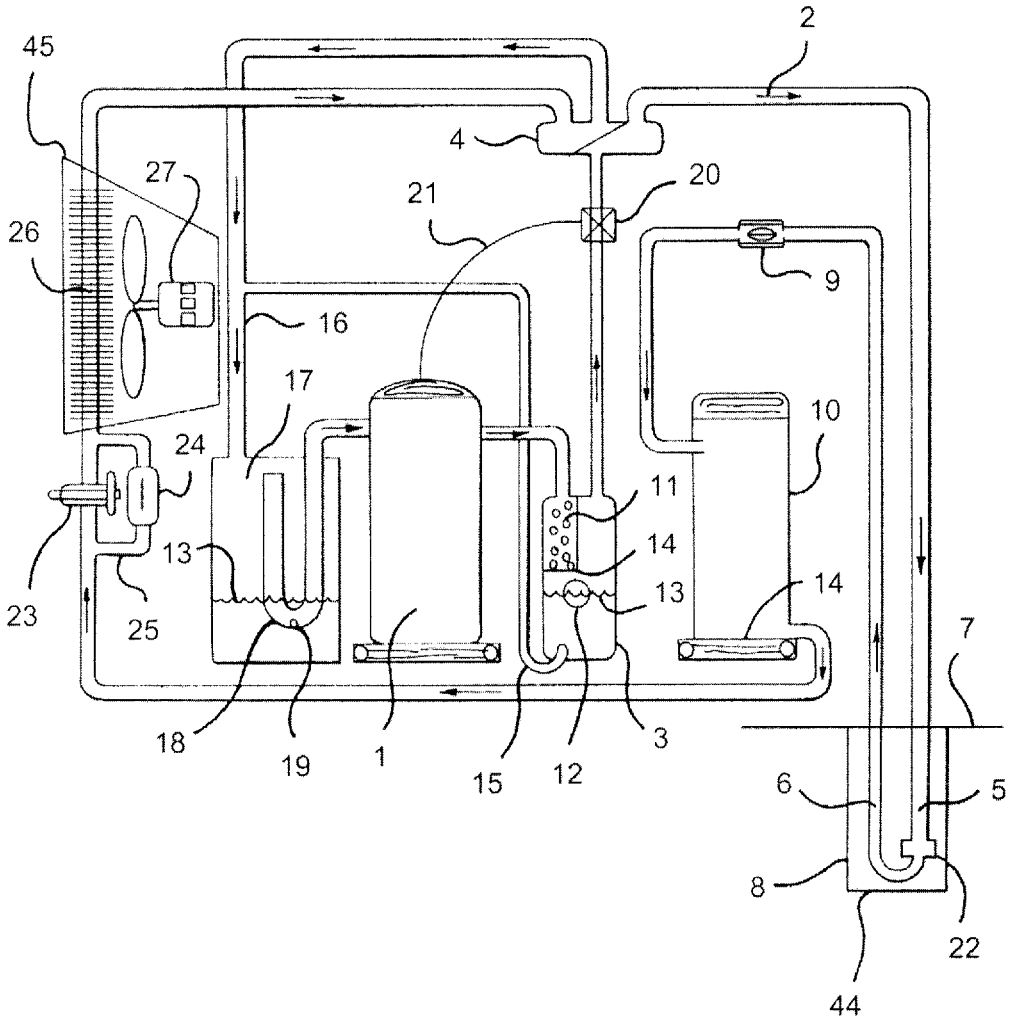
FIG. 1 is a side view of an operational DX system, with its geothermal heat exchange tubing situate in a vertically oriented well/borehole, with multiple preferred component designs.

Referring now to the drawings in detail, where like numerals refer to like parts or elements, FIG. 1 shows a side view, not drawn to scale, of a DX heat pump system operating in the cooling mode. The system includes a compressor 1, with a hot gas vapor refrigerant (not shown except for arrows 2 indicating the direction of the refrigerant flow) traveling from the compressor 1 into an oil separator 3. The compressor 1 is designed with an operating BTU capacity of between 80% and 95% of the maximum calculated heating/cooling load in BTUs. The refrigerant is preferably a refrigerant with an operating pressure at least 25% greater than that of R-22, such as a preferable R-410A, or the like. When operating at a pressure that is at least 25% greater than R-22, all other system components must have safe working load construction designs that are at least 25% greater than the safe working load construction of conventional R-22 system components. The refrigerant next flows through a reversing valve 4 (which changes the directional flow of the refrigerant from the cooling mode, as shown herein, to the heating mode, which is not shown herein but which is well understood by those skilled in the art) and then into the larger diameter vapor refrigerant transport line 5 of a subsurface geothermal heat exchanger, here shown as a preferred vertically oriented vapor line 5 situated within a well/borehole 8 The refrigerant then flows through a refrigerant tube coupling 22 into a smaller diameter liquid refrigerant transport line 6 also extending below the ground surface 7 into the same well/borehole 8, not drawn to scale, where the now mostly condensed refrigerant fluid travels out of the well/borehole 8. The refrigerant transport lines may be insulated in all areas where heat transfer is not desirous, and such insulation, being well understood, is not shown herein.

The preferred sizing and numbers of the larger diameter vapor refrigerant transport line 5 and the preferred sizing and numbers of the smaller diameter liquid refrigerant transport line 6 in a DX system, especially in a well/borehole 8 geothermal heat exchange system design, are dependent on actual system compressor 1 sizing, as more fully explained and set forth hereinabove in the Summary, Liquid and Vapor Line Sizing. The preferable total length, per ton of system design capacity, of the exposed sub-surface vapor line(s) 5 used for geothermal heat transfer in a well/borehole 8 design is also set forth hereinabove under the Summary, Liquid and Vapor Line Sizing.

The refrigerant, as explained, having been condensed into a mostly liquid state by the relatively cool sub-surface temperatures, then exits the well 8 and travels through a heating mode pin restrictor expansion device 9 in a reverse direction from that of system operation in the heating mode, in which cooling mode directional flow the refrigerant flow is not materially restricted (as it would be in the opposite heating mode directional flow not shown herein), as is well understood by those skilled in the art. The refrigerant next flows into a receiver 10. The receiver 10 is preferably designed to release all, or mostly all, of its contents when operating in the cooling mode, with the refrigerant flow naturally draining from the bottom 14 of the receiver 10, but is preferably designed (not drawn to scale) to contain 16%, when maximum latent load removal capacities are prefer red, and to preferably contain 8%, when maximum operational efficiencies are preferred, of the full potential liquid content of the exposed heat transfer portion of the larger diameter vapor line(s) 5 in the geothermal heat transfer field below the ground surface 7 in a preferable vertically oriented geothermal heat transfer design. The exposed heat transfer portion, below the ground surface 7, of the vapor line 5, here shown as one line 5, but potentially consisting of more than one line 5 (multiple sub-surface geothermal heat exchange vapor lines are not shown herein as multiple DX system designs with refrigerant flow provided by only one compressor 1 distributed to multiple vapor and liquid lines in multiple wells, or in other geothermal heat exchange loops, are well understood by those skilled in the art) is that portion of the vapor line 5 below the ground surface 7 and above the coupling 22 to the smaller diameter liquid line 6 near the base 44 of the well 8.

The compressor 1 is designed to provide an operational capacity of between 80% and 95% of the conventional compressor BTU operational design size for the subject maximum calculated heating/cooling tonnage load in BTUs. The compressor 1 has a high pressure cut-off switch 20 that is wired 21 to the compressor 1 so as to automatically turn off power to the compressor 1 if the hot gas head pressure reaches 500 psi, plus or minus 25 psi High pressure cut-off switches 20 for compressors 1 are well understood by those skilled in the art. However, for a system operating at higher pressures than an R-22 system, such as an R-410A system, for example, high pressure cut-off switches (with an example shown herein as 20) are typically set to cut-off at a 600, or greater, psi range.

The high pressure, hot refrigerant gas, exiting the compressor 1 travels into the oil separator 3, along with some compressor lubricant oil that naturally mixes with the refrigerant. This oil must be returned to the compressor 1, or the compressor 1 will eventually burn out. The oil separator 3 has a filter 11 with an ability to filter down to 0.3 microns and is preferably in excess of 98% efficient. A sight glass 12 is situated on the oil separator 3 so as to enable one to periodically view the adequacy of the oil level 13 within the separator 3 (when the system is inoperative), so as to insure the oil level 13 is preferably ½ inch (not drawn to scale) below the bottom 14 of the filter 11 (the amount of oil at this level constitutes the correct additional amount of oil to be added to the oil separator). When the system was operating, the level 13 of the oil within the separator 3 would not be apparent, as only a downward "sheathing" oil flow would be apparent (not shown herein).

Additionally, the oil return line 15 from the oil separator 3 is here shown as traveling to the suction line 16 to the accumulator 17 (not directly to the compressor 1). The accumulator 17 has a U bend 18 inside with a small hole (or orifice) 19 in the bottom of the U bend 18, through which hole 19 the oil is pulled back into the compressor 1, along with some liquid refrigerant, by means of the compressor's 1 operational suction (which is well understood by those skilled in the art). An initial, additionally added, extra oil level 13 within the accumulator 17 is provided and shown (not drawn to scale) to be between 1/16 inch and ¼ inch above the hole 19 in the U bend 18. This additional extra oil amount is a safeguard to help insure there is always ample oil in the compressor 1, even though some minimal amount of oil will escape into the subsurface smaller diameter liquid refrigerant transport line 6 in the heating mode (not shown). Any such escaped oil will not return to the compressor 1 until the system is operated in the cooling mode, as shown herein, because the oil will mix and return with liquid refrigerant, but not with vapor refrigerant, from a deep well DX system application.

As explained, in the cooling mode as shown herein, after exiting the geothermal heat exchange line set comprised of larger and smaller diameter refrigerant transport lines, 5 and 6, situated below the ground surface 7, and after exiting through and/or around the heating mode pin restrictor 9, the refrigerant next flows into a receiver 10 From the receiver, 10, the refrigerant flows into the cooling mode expansion device 23, here shown as a self-adjusting expansion device (commonly called a TXV) 23. The IXV cooling mode expansion device 23 is shown here with a pressure regulated valve 24 in a TXV by-pass line 25. A pressure regulated valve 24 is well understood by those skilled in the art, and is designed to open and close at varying pre-determined refrigerant pressures so as to either permit, or preclude, the flow of refrigerant.

As noted above, refrigerant flow by-pass means, permitting additional refrigerant flow at least one of around and through a conventional TXV 23, is required in a DX system at the beginning of the cooling system when the ground is abnormally cold. Here, such a pressure regulated valve 24 by-pass means should preferably be comprised of a valve 24 that permits full refrigerant flow through the by-pass line 25 and the valve 24 until the system's compressor 1 psi suction pressure reaches at least 80 psi, plus or minus 20 psi for a particular preferred design, at which point the valve would automatically close, so as not to thereafter impair TXV 23 operational function. Here, the valve 24 is shown in an open position to simulate the DX system operating in the cooling mode when the sub-surface geothermal heat exchange environment is abnormally cold.

As an alternative to the valve 24 shown herein in the TXV by-pass line 25, a secondary pin restrictor (not shown in FIG. 1, but similar to the first pin restrictor 9 depicted in the smaller diameter liquid refrigerant transport line 6) can be used in place of the valve 24, so long as the pin restrictor 9 sizing is pursuant to the sizing designs as set forth herein fox pin restrictors 9 in a TXV by-pass line 25. The secondary pin restrictor illustrated in FIG. 2.

To complete the refrigerant flow through the subject DX system design, the refrigerant exits the TXV 23, flows through an interior air handler 45, here shown as comprised of finned refrigerant transport tubing 26 and a fan 27 Interior air handlers 45, including their finned refrigerant transport heat exchange tubing 26 and fan 27 (typically called a blower in an interior air handler) are all well understood by those skilled in the art Finally, the refrigerant navels through the reversing valve 4, into the accumulator 17, and back into the compressor 1, where the process is repeated.

The interior air handler 45 finned tubing 26 contains approximately seventy-two linear feet, plus or minus twelve linear feet, of ⅜ inch O.D. finned tubing, with twelve to fourteen fins per lineal inch, per ton of system load design, in conjunction with an airflow of 350 to 400 CFM in the heating mode, and of 400 to 450 CFM in the cooling mode, with such airflow being provided by the fan 27.

Figure 2:
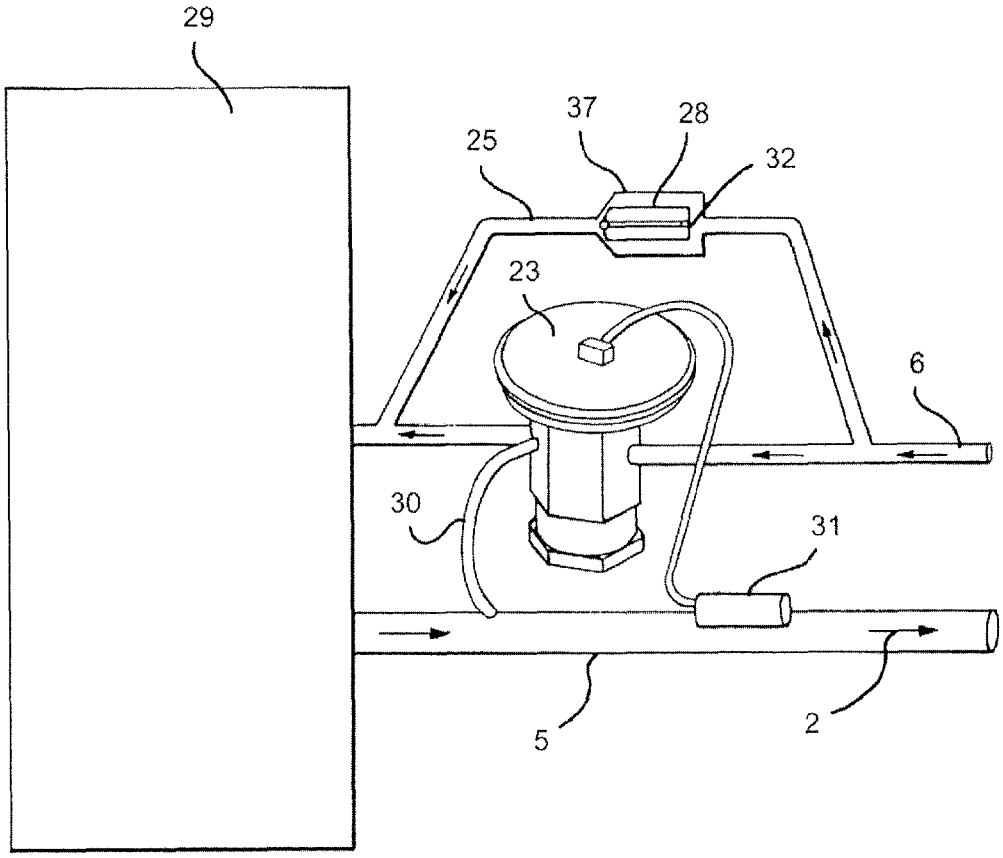
FIG. 2 is a side view of a TXV, with a pin restrictor in a TXV by-pass line, servicing an interior air handler in the cooling mode.

FIG. 2 is a side view of a IXV 23 in the smaller diameter liquid refrigerant transport line 6 transporting refrigerant fluid (not shown except for the directional flow indicated by arrows 2) into an interior air handler 29 (interior air handlers are well understood by those skilled in the art) in the cooling mode A cooling mode pin restrictor 28 is shown as situated in a TXV 23 by-pass line 25 traveling around the TXV 23. The cooling mode pin restrictor 28 is situated in a housing encasement 37, which is well understood by those skilled in the art. The cooling mode pin restrictor 28 has a small hole/bore (orifice) 32 that only permits a preferred design flow of refrigerant to pass through the pin 28 in the cooling mode, so as to provide enough refrigerant to the air handler 29 in the cooling mode when the sub-surface geothermal heat exchange environment is colder than normal, but so as not to provide too much refrigerant flow to impair the TXV's 23 operation when the sub-surface environment has attained normal, or above-normal, temperatures. The TXV 23 has a standard pressure sensing line 30 and a standard temperature sensor 31 attached to the larger diameter vapor refrigerant transport line 5 exiting the air handler 29 in the cooling mode.

The preferred size of the cooling mode pin restrictor's 28 small hole/bore (orifice) 32, when situated within the TXV 23 by-pass line 25 and used as a TXV 23 by-pass means, so as to only allow the preferred amount of refrigerant to pass through the hole/bore 32 in the cooling mode, is that as fully set forth hereinabove under Summary, Cooling Mode Expansion Device discussion.

Although not shown herein, a TXV 23 bleed port (not shown) may be used in lieu of, and in substitution for; a cooling mode pin restrictor 28 in the TXV 23 by-pass line 25. A TXV 23 bleed port (not shown) is well understood by those skilled in the art. The size of the bleed port orifice, which provides a supplemental refrigerant flow, may be equivalent to the same supplemental refrigerant flow as that provided by the cooling mode pin restrictor's 28 small hole/bore 32 when a cooling mode pin restrictor 28 is used as a TXV (cooling mode expansion device) 23 refrigerant flow by-pass means. When a IXV 23 bleed port is used, the by-pass line 25 is not needed.

Figure 3:
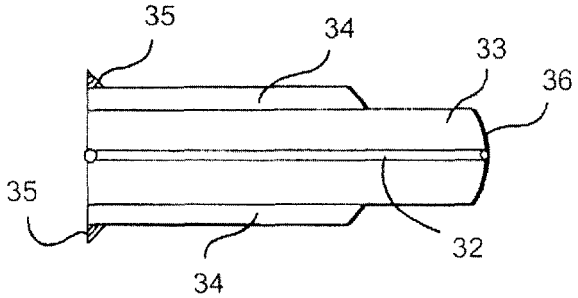
FIG. 3 is a side view of a pin restrictor.

FIG. 3 is a more detailed side view of a generic pin restrictor 33, with a small hole/bore (orifice) 32 in its center, with fins 34 and rear tips 35, which permit mostly unobstructed refrigerant flow (not shown herein) both through and around the pin 33 in an opposite mode of the one in which it is intended. The pin restrictor 33 is shown with the nose 36 of the pin 33 facing forward with the directional flow of the refrigerant.

When the pin 33 is intended for one of a heating mode expansion device and a TXV by-pass means, the rounded nose 36 of the pin 33 fits tightly against the forward housing (not shown herein as a pin's 33 housing encasement is well understood by those skilled in the art) and restricts the refrigerant flow to a preferred metered amount solely permitted through the small hole/bore (orifice) 32.

When the pin is used as an expansion device in the heating mode, the size of the small hole/bore (orifice) 32, plus or minus 10%, should preferably be designed to match the DX system's actual compressor (not shown herein, but shown in FIG. 1) BTU size, as more fully set forth in the above Summary, Heating Mode Expansion Device discussion.

When the pin 33 is used as a TXV (not shown herein, but shown in FIG. 2 above) by-pass means, the size of the small hole/bore (orifice) 32, plus or minus 10%, should preferably be designed to match the DX system's actual compressor (not shown herein, but shown in FIG. 1) BTU size, as more fully set forth in the above Summary, Cooling Mode Expansion Device discussion.

Figure 4:
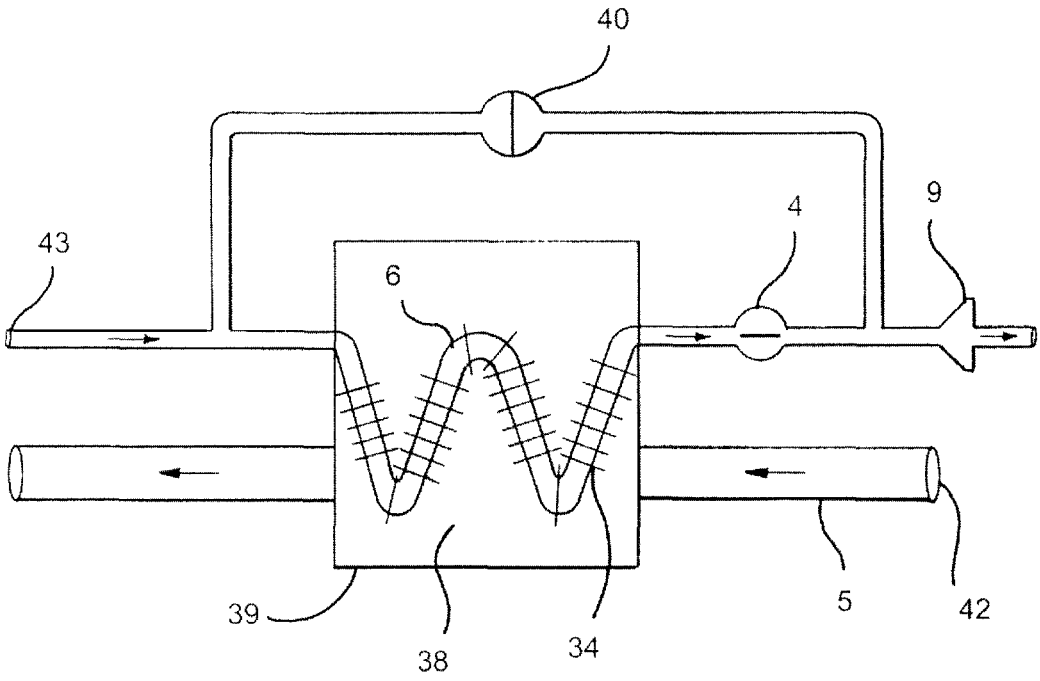
FIG. 4 is a side view of a vapor line pre-heater.

FIG. 4 is a side view of a vapor line pre-heater 38. Here, the incoming warmed refrigerant vapor arriving from the geothermal sub-surface heat exchange means of a DX system operating in the heating mode is shown as traveling within its larger diameter vapor refrigerant transport line 5. The vapor line 5 enters a vapor line pre-heater 38, here shown as a box 39 (any containment means is acceptable) from the field side 42. The box 39 contains at least one finned 34 smaller diameter liquid refrigerant transport line 6. While a finned 34 liquid line 6 is shown herein within the box 39, the liquid line 6 within the box 39 could alternately be comprised of a plate refrigerant transport heat exchanger; or the like.

The refrigerant flow within the finned 34 liquid line 6 comes from the DX system's interior air handler (FIG. 1) side 43 in the heating mode. As the refrigerant flow within the finned 34 liquid line 6 exits the box 39, it next preferably travels to the heating mode expansion device 9. As the refrigerant flow, which has entered the box 39 from the vapor line 5 from the field side 42, exits the box 39, it next preferably travels through the DX system's reversing valve (FIG. 1) to the DX system's accumulator, so as to provide warmer incoming refrigerant vapor to the compressor, and, hence, warmer refrigerant vapor to the interior air handler for warmer supply air.

Simultaneously, with heat being removed from the warm refrigerant within the liquid line 6 exiting the air handler (not shown) in the heating mode, after it has traveled through the box 39 and has transferred heat (via natural heat transfer, as heat naturally travels to cold) to the cooler refrigerant entering the box 39 from the field side 42 within the vapor line 5, before the refrigerant vapor enters the compressor (not shown) in the heating mode, the refrigerant within the liquid line 6 next preferably flows to the heating mode expansion device 9 where the refrigerant is now cooler than normal, so as to create a larger temperature differential between the refrigerant and the natural sub-surface geothermal temperature and improve natural heat gain abilities.

The vapor line 5 servicing the pre-heater 38 assembly is shown herein with a first check valve 40 which is closed in the heating mode, and with a second check valve 41 which is open in the heating mode, so as to force the liquid refrigerant through the pre-heater 38 box 39 in the heating mode. In the cooling mode, the first check valve 40 would be opened, and the second check valve 41 would be closed, to keep the liquid refrigerant out of the box 39 to prevent unwanted additional heat in the heating mode.

While only certain embodiments have been set forth, alternatives and modifications will be apparent from the above description to those skilled in the art. These and other alternatives are considered equivalents and within the spirit and scope of this disclosure and the appended claims.

What is claimed is:

1. A direct exchange geothermal heating/cooling system comprising:

a geothermal heat exchange field;

refrigerant transport lines including a liquid refrigerant transport line and a vapor refrigerant transport line;

a compressor sized between 80% and 95% of a maximum heating/cooling load;

expansion devices;

a heat exchanger;

an oil separator having a filter configured to separate a particle size no greater than approximately 0.3 microns and to provide at least approximately 98% efficiency;

a refrigerant having an operating pressure at least 25% greater than R-22;

a high pressure cut-off switch operably coupled to the compressor and configured to shut off the compressor when an operational system pressure reaches approximately 500 psi, plus or minus approximately 25 psi; and wherein each of the geothermal heat exchange field, refrigerant transport lines, compressor, expansion devices, heat exchanger, oil separator, and high pressure cut-off switch has at least a 25% greater safe working load strength than a safe working load strength of components in an R-22 refrigerant system.

2. The system of claim 1, in which additional oil is disposed in the oil separator to a level approximately ½ inch, plus or minus approximately ¼ inch, below a bottom of the oil filter.

3. The system of claim 2, in which the oil separator further includes a sight glass for viewing an oil fill level in the oil separator.

4. The system of claim 1, further comprising an accumulator disposed in a suction line fluidly communicating with the compressor, the accumulator including a U-bend and an oil return orifice disposed at a base of the U-bend, and in which additional oil is deposited into the accumulator to a level approximately 1/16-¼ of an inch above the oil return orifice.

5. The system of claim 1, in which the refrigerant comprises R-410A.

6. The system of claim 1, further comprising an air handler and a receiver disposed in the liquid refrigerant transport line between the air handler and the expansion device, a heating mode liquid refrigerant transport line exiting an upper portion of the receiver and a cooling mode liquid refrigerant transport line exiting a lower portion of the receiver.

7. The system of claim 6, in which an interior space of the receiver between the heating mode liquid refrigerant transport line and the cooling mode liquid refrigerant transport line is sized to contain approximately 16%, plus or minus approximately 2%, of a full potential liquid content of an exposed heat transfer portion of the vapor refrigerant transport line in the geothermal heat exchange field for a maximum latent load removal capacity.

8. The system of claim 6, in which an interior space of the receiver between the heating mode liquid refrigerant transport line and the cooling mode liquid refrigerant transport line is sized contain approximately 8%, plus or minus approximately 2%, of a full potential liquid content of an exposed heat transfer portion of the vapor refrigerant transport line in the geothermal heat exchange field for maximum operational efficiencies.

9. The system of claim 1, in which a line set sizing design for a 30,000 BTU capacity, or less, compressor comprises at least one and no more than two ⅜ inch O.D. refrigerant grade liquid refrigerant transport line(s), in conjunction with a corresponding number of at least one and no more than two vapor refrigerant grade transport line(s) with each vapor line having an O.D. that is between 2 to 2.4 times as large as the O.D. of the liquid line.

10. The system of claim 9, in which the geothermal heat exchange field has a heat transfer rate of at least 1.4 BTU/Ft.Hr. Degrees F, wherein the system further comprises at least 120 feet of exposed vapor line per ton of a greater of heating and cooling design load capacities.

11. The system of claim 1, in which a line set sizing design for a compressor above a 30,000 BTU capacity, but less than a 90,000 BTU capacity, comprises at least two and no more than three ⅜ inch O.D. refrigerant grade liquid refrigerant transport line(s), in conjunction with a corresponding number of at least two and no more than three vapor refrigerant grade transport line(s) with each vapor line having an O.D. that is between 2 to 2.4 times as large as the O.D. of the liquid line.

12. The system of claim 11, in which the geothermal heat exchange field has a heat transfer rate of at least 1.4 BTU/Ft.Hr. Degrees F, wherein the system further comprises at least 120 feet of exposed vapor line per ton of a greater of heating and cooling design load capacities.

13. The system of claim 1, in which at least two and no more than three wells/boreholes are provided so that the liquid refrigerant transport line includes a primary line and distributed lines, and in which the vapor refrigerant transport line includes a primary line and distributed lines, wherein, for system compressor design loads of over 30,000 BTUs and up to 90,000 BTUs, the primary liquid refrigerant transport line comprises ½ inch O.D. refrigerant grade line, the primary vapor refrigerant transport line comprises ⅞ inch O.D. refrigerant grade line, the distributed liquid refrigerant transport lines comprise ⅜ inch O.D. refrigerant grade lines, and the distributed vapor refrigerant transport lines comprise ¾ inch O.D. refrigerant grade lines.

14. The system of claim 1, further comprising an interior air handler containing approximately 72 linear feet, plus or minus approximately 12 linear feet, of ⅜ inch O.D. finned tubing, with 12 to 14 fins per lineal inch, per ton of system load design, The interior air handler further being sized to produce an airflow of 350 to 400 CFM in the heating mode, and of 400 to 450 CFM in the cooling mode.

15. The system of claim 1, further comprising a pin restrictor expansion devices, in which the pin restrictor expansion device is sized according to the compressor size as set forth below, plus or minus 10%, where the pin restrictor expansion size is provided in inches and the compressor size is provided in BTUs, and wherein a heating mode load is approximately two thirds or less of a cooling mode load:

Compressor BTUs—Heating Mode —Pin Restrictor Bore Size In Inches

For A Single Line DX System (One Pin Of The Size Outlined Below In The Sole Liquid Line To The Field) —Heating Mode

| | |
|---|---|
| 13,400 | 0.034 |
| 16,000 | 0.039 |
| 18,000 | 0.041 |
| 19,000 | 0.042 |
| 20,000 | 0.044 |
| 20,100 | 0.044 |
| 21,000 | 0.045 |
| 22,000 | 0.046 |
| 23,000 | 0.048 |
| 24,000 | 0.049 |
| 25,000 | 0.050 |
| 26,000 | 0.051 |
| 26,800 | 0.052 |
| 27,000 | 0.052 |
| 28,000 | 0.053 |
| 29,000 | 0.054 |
| 30,000 | 0.055 |

For A Double Line DX System (Two Pins . . . One Pin Of The Size Outlined Below In Each Of Two Liquid Lines To The Field When The Primary Liquid Line Is Equally Distributed Into Two Liquid Refrigerant Transport Lines)—Heating Mode

| | |
|---|---|
| 31,000 | 0.040 |
| 32,000 | 0.040 |
| 33,000 | 0.040 |
| 34,000 | 0.041 |
| 34,170 | 0.041 |
| 35,000 | 0.041 |
| 36,000 | 0.042 |
| 37,000 | 0.043 |
| 38,000 | 0.043 |
| 39,000 | 0.043 |
| 40,000 | 0.044 |
| 41,000 | 0.044 |
| 42,000 | 0.044 |
| 43,000 | 0.044 |
| 44,000 | 0.045 |
| 45,000 | 0.045 |
| 46,000 | 0.045 |
| 47,000 | 0.046 |
| 48,000 | 0.046 |
| 49,000 | 0.046 |
| 50,000 | 0.047 |
| 51,000 | 0.047 |
| 52,000 | 0.047 |
| 53,000 | 0.047 |
| 54,000 | 0.048 |
| 55,000 | 0.049 |
| 56,000 | 0.049 |
| 57,000 | 0.050 |
| 58,000 | 0.050 |
| 59,000 | 0.050 |
| 60,000 | 0.050 |

For A Triple Line DX System (Three Pins . . . One Pin Of The Size Outlined Below In Each Of Three Liquid Lines To The Field When The Primary Liquid Line Is Equally Distributed Into Three Liquid Refrigerant Transport Lines)—Heating Mode

| | |
|---|---|
| 87,000 | 0.048 |

HEATING MODE PIN RESTRICTOR SIZE, IN INCHES, PER SYSTEM COMPRESSOR SIZE IN BTUs, WHEN THE COOILNG MODE LOAD DESIGN IS OVER TWO-THIRDS OF THE HEATING MODE LOAD DESIGN.

Compressor BTUs—Heating Mode —Pin Restrictor Bore Size In Inches

For A Single Line DX System (One Pin Of The Size Outlined Below In The Sole Liquid Line To The Field)—Heating Mode

| Compressor Size | Pin Size |
|---|---|
| 13,400 | 0.031 |
| 16,000 | 0.036 |
| 18,000 | 0.038 |
| 19,000 | 0.039 |
| 20,000 | 0.040 |
| 20,100 | 0.040 |
| 21,000 | 0.042 |
| 22,000 | 0.043 |
| 23,000 | 0.044 |
| 24,000 | 0.045 |
| 25,000 | 0.046 |
| 26,000 | 0.047 |
| 26,800 | 0.048 |
| 27,000 | 0.048 |
| 28,000 | 0.049 |
| 29,000 | 0.050 |
| 30,000 | 0.051 |

For A Double Line DX System (Two Pins . . . One Pin Of The Size Outlined Below In Each Of Two Liquid Lines To The Field When The Primary Liquid Line Is Equally Distributed Into Two Liquid Refrigerant Transport Lines)—Heating Mode

| Compressor Size | Pin Size |
|---|---|
| 31,000 | 0.036 |
| 32,000 | 0.037 |
| 33,000 | 0.037 |
| 34,000 | 0.038 |
| 34,170 | 0.038 |
| 35,000 | 0.038 |
| 36,000 | 0.038 |
| 37,000 | 0.039 |
| 38,000 | 0.040 |
| 39,000 | 0.040 |
| 40,000 | 0.040 |
| 41,000 | 0.041 |
| 42,000 | 0.041 |
| 43,000 | 0.041 |
| 44,000 | 0.042 |
| 45,000 | 0.042 |
| 46,000 | 0.042 |
| 47,000 | 0.042 |
| 48,000 | 0.042 |
| 49,000 | 0.043 |
| 50,000 | 0.043 |
| 51,000 | 0.043 |
| 52,000 | 0.044 |
| 53,000 | 0.044 |
| 54,000 | 0.044 |
| 55,000 | 0.045 |
| 56,000 | 0.045 |
| 57,000 | 0.045 |

-continued

| Compressor Size | Pin Size |
|---|---|
| 58,000 | 0.046 |
| 59,000 | 0.046 |
| 60,000 | 0.046 |

For A Triple Line DX System (Three Pins . . . One Pin Of The Size Outlined Below In Each Of Three Liquid Lines To The Field When The Primary Liquid Line Is Equally Distributed Into Three Liquid Refrigerant Transport Lines)—Heating Mode

| Compressor Size | Pin Size |
|---|---|
| 83,000 | 0.044. |

16. The system of claim 13 where the preferred size of the hole/bore (orifice) within at least one of a pin restrictor expansion device, by-passing the TXV expansion device in the air handler, and a TXV bleed port in the TXV servicing the air handler, is as per the following design equivalencies, plus or minus 10%, in the cooling mode:

| Actual Compressor Size n BTUs | Pin Size, also known as the interior hole/bore (orifice) size, in inches, for a TXV refrigerant flow supplement (by-pass) means |
|---|---|
| 16,000 BTUs | 0.044 |
| 21,000 BTUs | 0.050 |
| 25,000 BTUs | 0.055 |
| 29,000 BTUs | 0.059 |
| 32,000 BTUs | 0.062 |
| 38,000 BTUs | 0.065 |
| 44,000 BTUs | 0.070 |
| 51,000 BTUs | 0.076 |
| 54,000 BTUs | 0.078 |
| 57,000 BTUs | 0.081. |

17. The system of claim 16 where a pressure regulated valve is utilized in the TXV by-pass line, and where the pressure regulated valve is designed so as to permit full refrigerant flow through the valve until the compressor's suction pressure reached 80 psi, plus or minus 20 psi, at which point the valve would automatically close, with the system thereby fully functioning without any refrigerant TXV by-pass flow.

18. The system of claim 1, operating in the heating mode, with a vapor line pre-heater that would be comprised of a heat exchanger situated between the warm, mostly liquid, refrigerant transport line exiting the system's interior air handler, at a location before the refrigerant flow reaches the heating mode expansion device, and the refrigerant vapor transport line exiting the geothermal heat exchange means, before the refrigerant flow exiting the geothermal heat exchange means entered the system's compressor, which vapor line pre-heater would be by-passed and not utilized in the cooling mode.

* * * * *